US005933082A

United States Patent [19]

Abita et al.

[11] Patent Number: 5,933,082

[45] Date of Patent: Aug. 3, 1999

[54] PASSIVE ALARM SYSTEM FOR BLIND AND VISUALLY IMPAIRED INDIVIDUALS

[75] Inventors: Joseph Lawrence Abita, Boyds; John Sadowsky; Wolfger Schneider, both of Columbia; Robert W. Massof, Uniontown, all of Md.

[73] Assignee: The Johns Hopkins University, Baltimore, Md.

[21] Appl. No.: 08/624,671

[22] Filed: Apr. 2, 1996

Related U.S. Application Data

[60] Provisional application No. 60/005,180, Sep. 26, 1995.

[51] Int. Cl.[6] ..... G08B 21/00

[52] U.S. Cl. ..... 340/541; 250/338.1; 250/341.2; 250/395; 340/540; 340/573; 340/600; 340/825.19; 356/256

[58] Field of Search ..... 340/825.19, 573, 340/540, 541, 600; 250/338.1, 341.2, 395; 356/256

[56] References Cited

U.S. PATENT DOCUMENTS 3,924,130 12/1975 Cohen et al. ..... 250/342
4,648,710 3/1987 Ban et al. ..... 356/135
4,712,003 12/1987 Ban et al. ..... 250/221
4,947,152 8/1990 Hodges ..... 340/573
5,126,718 6/1992 Doctor ..... 340/567
5,266,807 11/1993 Neiger ..... 250/353

*Primary Examiner*—Glen Swann
*Attorney, Agent, or Firm*—Eugene J. Pawlikowski; Carla Magda Krivak

[57] ABSTRACT

The device assists those who are visually handicapped and, in particular, warns blind or visually impaired travellers that they have entered a potentially dangerous area proximal to the edge of boarding platforms of the type typically found in public railway transit systems. An InfraRed Integrated Information System consists of an array of infrared transmitters and a portable detector/warning device to be held by the blind traveller. The transmitters create a beam of infrared light which bathes the section of the platform proximal to the platform edge. As the traveller moves into the region of the platform covered by the emission, the sensors in the warning device are activated and by audio, tactile or other stimuli alert the traveller of entry into the danger zone.

31 Claims, 2 Drawing Sheets

Overhead IR source
Active detection area
Tactile signal
Quiet detector
" Smart " LED
10
12
13
14
16
17
18
19
20
24
26
28
30
d
ℓ

PASSIVE ALARM SYSTEM FOR BLIND AND VISUALLY IMPAIRED INDIVIDUALS

This application claims the benefit of U.S. Provisional application No. 60/005,180 filed Sep. 26, 1995.

BACKGROUND OF THE INVENTION

1. Field of the Invention

The present invention relates to a system for protecting the health of the visually handicapped such as those afflicted with blindness or near blindness and, particularly, to a system which compensates for the relative inability of blind people to provide maximum personal safety when moving on or about the platform of a public railway transit system while approaching a train with the intention of boarding one of its coaches. Although no completely reliable statistics are available, the most widely used estimates in 1994 place the legally blind population of the United States at 2.24 per thousand (that is, approximately 500,000) Approximately 50,000 become legally blind annually, and many others have enough visual loss to pose a serious employment problem (*General Ophthalmology*, Vaughn et al, Norwalk, Conn., Appleton & Lange, 1992).

2. Description of the Related Art

The expansion of high speed railway transit systems to many major cities throughout the world, while viewed by many as merely another sign of technological achievement associated with a modern society, is generally undertaken with less than adequate consideration of the problems of persons who are physically handicapped. It is unfortunate that this sweeping hypothesis finds greater application when applied to the blind. The requirements imposed on designers of public railway transit systems by the Americans with Disabilities Act is a step in the direction of recognizing the needs of a minority population using modern technology to enhance the safety and accessibility of subway systems for the blind or visually impaired. One such effort is being prepared in response to a request by the Washington Metropolitan Area Transit Authority (WMATA) for assistance to comply with requirements recently laid down by the Federal Transit Authority. The federal requirements, in turn, are intended to promote development which will improve the accessibility to users who have little or no forward vision. One particular desire underpinning these requirements is to design ways to identify platform edges and other potential safety hazards to a class of commuters who lack the sense of sight needed to detect and avoid such hazards. Although the particular requirements of the Federal Transit Authority are quite specific as to the set of users targeted to benefit, design requirements can be considered to resemble a general type of synthetic environment system in which a personal user interface system is used to translate a sensory environmental signal of one type into sensory user inputs of a different type. When placed into practice, this concept may be implemented by replacing visual clues not ordinarily available to the blind or visually impaired with substitute inputs such as the auditory or tactile kind.

The Federal Transit Authority originally mandated the installation of strips of truncated domes or bumps mounted on the platform floor near the edge, in two-feet widths, to act as an underfoot tactile warning to the blind as they walk into this region. Promoters of this design operated under the premise that when such bumps are detected underfoot the subway user will recognize impending danger and come to a halt before reaching the edge of the platform. WMATA, with the support of the National Federation of the Blind, objected to the Maginot Line concept for several reasons, including the following:

1. The bump strips are not effective enough: visually impaired travellers are first made aware of the platform edge by the bumps at a distance which is short when one considers the range of human reaction times—most people must slow down and anticipate the edge long before the final two feet.

2. The bump strips are potential safety hazards to sighted as well as visually impaired people as something to trip over, for example, those wearing high heels, operators of wheelchairs, strollers and the like. At the very least, they call attention by a non-aesthetic marring of the subway platform to attempt to accommodate a very small number of commuters.

3. Bump strips are unnecessary for many skilled blind or visually impaired users who have been trained to navigate efficiently with sound cues and by cane without interfering with habits of sighted passengers.

4. The bump strips do not address more serious difficulties in subway stations, such as the ability to discriminate between the door openings in rail cars and the openings between rail cars, location of escalators, elevators, fare card machines, etc.

5. Any solution proposing platform bumps is expensive based on WMATA estimates to install and maintain such a system.

6. The use of truncated-dome system is not voluntary.

7. There is no distance-from-the-platform edge information which can be extracted from this implementation.

The NFB has recommended that technology can be applied to develop an equivalent facilitation warning system that is less costly, has the additional benefit of being voluntary (for users), provides additional information, and is extendible to other access and area identification problems. The warning signal should be virtually undetectable to sighted users and should not require blind or visually impaired users, who wish to take advantage of the technology, to do anything extraordinary to use it. Moreover, in using the system one should appear natural and should not require extensive or complex training. It should be easy to use, even by people who have little or no familiarity with technical devices.

Intruder indication is provided for in U.S. Pat. No. 5,126,718 but the system described therein depends upon the reflection of infrared radiation from an intruder entering a protected field of view. The system described in U.S. Pat. No. 4,712,003 provides a blind person guide device whose sonar can indicate bearing and distance from an object in which the distance to an object lying in the direction in which the range finder faces is transmitted or perceived as vibrations felt through the handle of a walking stick. Neither of the prior art apparatus addresses a particular danger faced by blind people who out of necessity rely on rail transportation.

SUMMARY OF THE INVENTION

The present invention offers to the visually handicapped assistance to avoid injury by tolerating no penetration of the area proximal to the edge of a public railway transit platform without sufficient warning being issued in a form unreservedly detectable by the blind. Such rehabilitation assistance enables a handicapped person to use rail transportation with as little discomfort as possible. Public transportation, especially of the kind requiring unguided assistance to the boarding area along the edge of a train platform, is fraught with danger to a blind person intent on carrying out an independent existence with a minimum of public assistance. Sonar sensor canes and guide dogs (less than 2% of blind people in the United States use guide dogs), offer some help during mobility training but they fall short of providing trustworthy cues to the blind symbolizing proximity to a platform edge.

Accordingly, an object of the present invention is to reduce risk of injury by providing a platform edge warning system for blind and visually impaired persons using public railway transit systems.

Another object of the invention is a platform edge warning signal which is invisible and normally undetectable to persons having normal sight.

Still another object is a platform edge warning signal that is discreet, inconspicuous, clearly discriminatable, personal, and usable strictly at the option of the person who wishes to utilize the system.

Yet a further object is an architecturally sensitive and aesthetically pleasing physical implementation easily engendered into the physical environment of the typical above-ground or below-ground public railway transit systems.

Other objects of the invention will become apparent from the following detailed description of the embodiment of the present invention when taken in conjunction with the accompanying drawings.

DESCRIPTION OF THE INVENTION EMBODIMENT

Figures 1, 2:
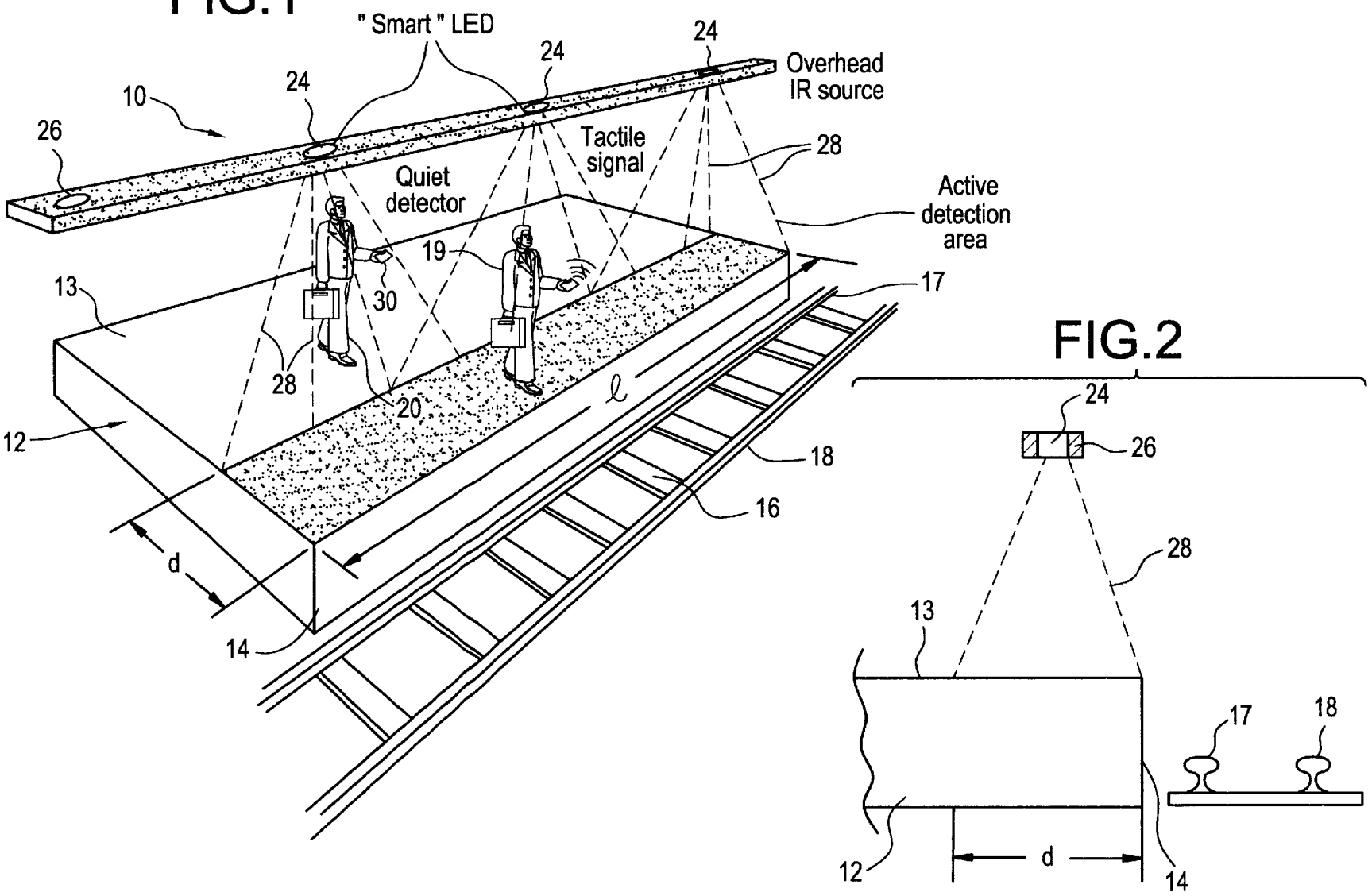
FIG. 1 shows in perspective a view of a platform edge warning system according to the present invention.
FIG. 2 is a fragmentary view of the system shown in FIG. 1 and demonstrates the relationship of overhead transmitters to the floor of a rail-side platform.

As shown in FIG. 1, the platform edge warning system which embodies the present invention is generally designated 10 and comprises a platform 12 whose floor 13 terminates at an edge 14 proximal to a railway 16 having parallel rails 17 and 18 which support a passenger vehicle (not shown) controlled to come to complete halt at platform 12 for the purpose of permitting passengers on the platform to board or disembark from a train. Serious injuries and deaths have been documented as the result of contact with trains made by travellers who accidentally proceed beyond the edge of the platform while the train is in motion. Two such travellers 19 and 20 are pictured standing on the floor 13 of platform 12 and both are assumed for the sake of illustration to be blind or visually impaired to the extent that they are unable to visually determine with exactness the edge 14 of the platform while remaining a safe distance from its edge.

The proposed platform edge warning system 10 further includes an array of transmitters 24 supported by a structural member 26, such as an overhead beam which provides a flat surface mounting in a plane above or adjacent to platform 12. Spaced uniformly longitudinally on the member 26 in a direction substantially parallel to the platform edge 14, the transmitters are adapted to create a well-defined detectable hazard zone within the boarding area proximal to the platform edge. The vertical separation of the member 26 from the floor of platform 12 is depicted more clearly in the fragmentary view of the system shown in FIG. 2.

In operation, each of the transmitters 24 emits an encoded radiated signal of downwardly directed energy represented herein for convenience by dashed lines 28 which define a zone A one side of which is contiguous with the edge 14 of the platform. The dimensions of zone A, that is, length l and depth d, are selected so that the shower of radiation proximal to the edge of the platform is broad enough to envelope the person of the traveller 19 during entry into the boarding area. Traveller 20, on the other hand, is staged in FIG. 1 at a position on platform 14 beyond or outside zone A. It can be seen from the drawings that the shower of radiation coextensive with zone A extends up to and includes the section of the platform proximal to the edge 14.

Figure 3:
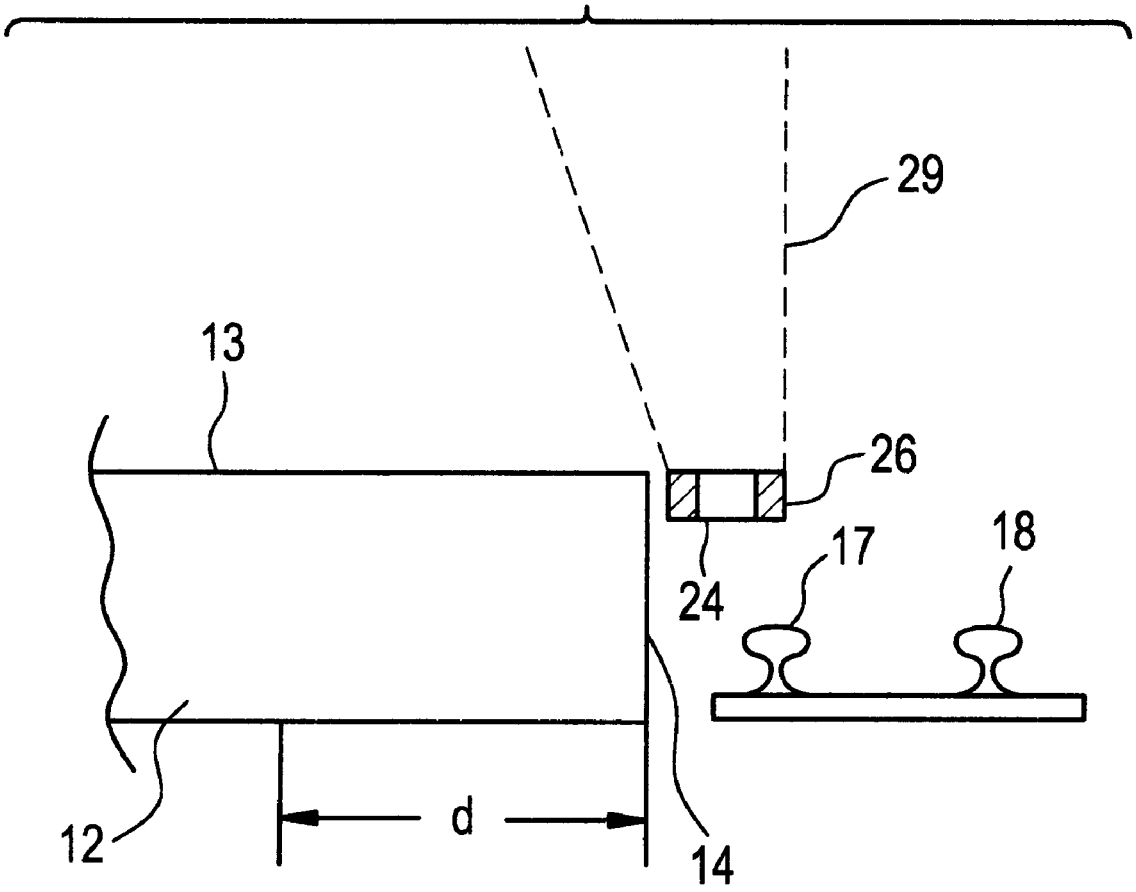
FIG. 3 is a fragmentary view of the system shown in FIG. 1 and demonstrates the relationship of transmitters adjacent to the floor of the rail-side platform.

FIG. 3 is a fragmentary view of the system shown in FIG. 1 and shows the transmitters 24 adjacent to platform 12. The transmitters 24 in FIG. 3 function the same as the transmitters 24 in FIG. 2, except that the transmitters 24 in FIG. 3 emit an encoded upwardly radiated signal denoted by dashed lines 29 which define the hazard zone A.

In order for the platform edge warning system 10 to operate as intended, each traveller 19 and 20 is equipped with a portable detector 30 which contains a radiated signal responsive element selectively tuned to the wavelength of the signals emitted by transmitters 24. The detector held by traveller 19 will become activated the moment the detector is exposed to the transmitted signals. Being outside zone A at this point, the detector held by traveller 20 will not be affected. Detectors 30 have in common the fact that both are designed to emit a warning signal upon being activated. Therefore, it will be appreciated that traveller 19 will receive a warning advising of proximity of the edge 14 of the platform. Until traveller 20 enters zone A the detector being carried will remain silent.

Although it is proposed to use transmitters broadcasting over different portions of the frequency spectrum, such as an evaluation of ultrasound, microwave, and radio frequency alternatives, it is believed that a solution which relies on radiation in the optical region, particularly, radiating in the infrared region is far superior to these alternatives. No concern is therefore required about RF or microwave noise or interference nor do any difficulties arise because of radiation health hazards. So far as the design selection for the type of warning to be given by the portable detectors, coded vibrotactile stimulation is seen as advantageous over synthesized speech or other audible warnings because it is discreet, unobtrusive, and not affected by the high ambient sound levels routinely found in subway stations.

As will be appreciated from the foregoing description, the disclosed development of technology for warning travellers that they are approaching the platform edge of railway transit stations is far superior, in results obtained, to any underfoot warning system, both functionally and aesthetically, and has the potential for expansion to other areas of use such as, for example, entrances, exits, fare machines, restrooms, escalators, elevators, telephones, and the like. The system signals are nonexistent so far as sighted travellers are concerned and the platform edge warning issued to those who are relying on the caution signal for their safety is discreet, inconspicuous, discriminable from outside stimuli, of a personal nature, and entirely optional for participation. Installed parts of the system may be designed to complement the station architecture so as to be unobtrusive and easy to use with only minimum instruction. This invention can be implemented, i.e., installed in a number of configurations as appropriate to the intent of its application. It is further supposed that central control centers within each station would have in stock a sufficiently large number of portable warning devices for elective distribution to the blind or visually impaired traveller upon entering the system with the acknowledgement, tacit or otherwise, that the warning device be returned to the center once the traveller exits the system.

What is claimed is:

1. In a public transportation system of the class wherein a passenger-carrying vehicle has an assigned route which takes it into proximity with the edge of a passenger-boarding platform frequented by blind and/or visually impaired persons in the course of boarding the vehicle without human assistance whereby said persons become endangered if their approach to a boarding area on said platform succeeds in placing them in the path of the vehicle while it approaches the platform for the purpose of taking on passengers once stopped at the boarding area, the combination with said system of a plurality of transmitters each of which emits encoded radiation in the infrared region which when projected onto the surface of said boarding area creates a hazard zone within said boarding area, and a detector mounted on or carried by said persons having a reception spectrum tuned to the signal emitted by said transmitters and activated when said persons enter said hazard zone.

2. The system of claim 1, wherein said system includes a structural member on a plane above said boarding area, and said transmitters being supported by said member.

3. The system of claim 1, wherein said system includes a structural member adjacent to said boarding area, and said transmitters being supported by said member.

4. The system of claim 1, wherein said detector gives a warning signal upon being activated by said transmitters thereby warning such persons of entry into said hazard zone.

5. The system of claim 4, wherein said warning signal is characterized by vibrotactile stimulation.

6. In a public transportation system of the class wherein a passenger-carrying vehicle has an assigned route which takes it into proximity with the edge of a passenger-boarding platform frequented by blind and/or visually impaired persons in the course of boarding the vehicle without human assistance whereby said persons become endangered if their approach to a boarding area on said platform succeeds in placing them in the path of the vehicle while it approaches the platform for the purpose of taking on passengers once stopped at the boarding area, the combination with said system of a plurality of transmitters each of which emits encoded radiation in the infrared region which when directed toward said boarding area creates a hazard zone of predetermined length and depth along the edge of said platform, and a detector mounted on or carried by said persons having a reception spectrum tuned to the signal emitted by said transmitters and activated when said persons enter said hazard zone.

7. The system of claim 6, wherein said system includes a structural member on a plane above said boarding area, and said transmitters being supported by said member.

8. The system of claim 6, wherein said system includes a structural member adjacent to said boarding area, and said transmitters being supported by said member.

9. The system of claim 6, wherein said detector gives a warning signal upon being activated thereby warning such persons of entry into said hazard zone.

10. The system of claim 9, wherein said warning signal is characterized by vibrotactile stimulation.

11. In a public transportation system of the class wherein a passenger-carrying vehicle has an assigned route which takes it into proximity with the edge of a passenger-boarding platform frequented by blind and/or visually impaired persons in the course of boarding the vehicle without human assistance whereby said persons become endangered if their approach to the edge of the platform succeeds in placing them in the path of the vehicle while it approaches the platform for the purpose of taking on passengers once it has been brought to a stop, apparatus dedicated to the protection of the blind comprising:

means for emitting an optical signal in the infrared spectrum, said signal being directed toward a boarding area on said platform, said boarding area being configured to demarcate a hazard zone of predetermined length extending parallel to the edge of said platform and predetermined depth perpendicular to and extending in a direction inboard of the edge of said platform, and means mounted on or carried by said persons having a reception spectrum tuned to said signal for issuing a warning to said persons when said persons enter said hazard zone.

12. The system of claim 11, wherein said system includes a structural member on a plane above said boarding area, and said means for emitting said optical signal being supported by said member.

13. The system of claim 11, wherein said detector gives a warning signal upon being activated thereby warning such persons of entry into the said hazard zone.

14. The system of claim 13, wherein said warning signal is characterized by vibrotactile stimulation.

15. In a public transportation system of the class wherein a passenger-carrying vehicle has an assigned route which takes it into proximity with the edge of a passenger-boarding platform frequented by blind and/or visually impaired persons in the course of boarding the vehicle without human assistance whereby said persons become endangered if their approach to a boarding area on said platform succeeds in placing them in the path of the vehicle while it approaches the platform for the purpose of taking on passengers once stopped at the boarding area, apparatus dedicated to the protection of the blind comprising:

a plurality of means each for generating an optical signal, said signals being directed toward a boarding area on said platform, said boarding area being configured to demarcate a hazard zone of predetermined length extending parallel to the edge of said platform and predetermined depth perpendicular to and extending in a direction inboard of the edge of said platform, and means mounted on or carried by said persons having a reception spectrum tuned to said optical signals for issuing a warning to said persons when said persons enter said hazard zone.

16. The system of claim 15, wherein said means for generating an optical signal emits radiation in the infrared spectrum and said detector is sensitive to the infrared radiation incident thereon.

17. The system of claim 15, wherein said system includes a structural member on a plane above or adjacent to said boarding area, and said means for generating an optical signal being supported by said member.

18. The system of claim 15, wherein said detector gives a warning signal upon being activated thereby warning such persons of entry into said hazard zone.

19. The system of claim 18, wherein said warning signal is characterized by vibrotactile stimulation.

20. In a public transportation system of the class wherein a passenger-carrying vehicle has an assigned route which takes it into proximity with the edge of a passenger-boarding platform frequented by blind and/or visually impaired persons in the course of boarding the vehicle without human assistance whereby said persons become endangered if their approach to the edge of the platform succeeds in placing them in the path of the vehicle as it approaches the platform for the purpose of taking on passengers once it has been brought to a stop, the combination with said system of a plurality of transmitters each of which emits a detectable optical signal which impinges on a selected portion of said platform large enough to create a hazard zone of predetermined length and depth within the boarding area of said platform, and a detector mounted on or carried by said persons having a reception spectrum tuned to the signals emitted by said transmitters and activated when said persons enter said hazard zone.

21. The system of claim 20, wherein said transmitters emit radiation in the infrared spectrum and said detector is sensitive to the infrared radiation incident thereon.

22. The system of claim 20, wherein said system includes a structural member on a plane above said boarding area, and said transmitters being supported by said member.

23. The system of claim 20, wherein said detector gives a warning signal upon being activated thereby notifying such persons of entry into said hazard zone.

24. The system of claim 23, wherein said warning signal is characterized by vibrotactile stimulation.

25. The method of improving the safety of blind individuals during their approach to a public rail transportation vehicle with the intention of boarding the vehicle from a stationary boarding platform unassisted by other humans which comprises the steps of:

identifying a boarding area on said platform, establishing within said boarding area a hazard zone which terminates a predetermined distance inwardly from the edge of said platform, exposing said hazard zone to a detectable optical signal, equipping said blind individuals with a detector, and using said signal to activate said detector upon entry of said blind into said hazard zone.

26. The method recited in claim 25, wherein said step of exposing is carried out with an infrared signal emitting device.

27. The method recited in claim 25, wherein said detector responds to infrared radiation.

28. The method as recited in claim 25, which further comprises the step of:

suspending above said platform the means for exposing said hazard zone to said optical signal.

29. The method as recited in claim 25, which further comprises the step of:

producing from said detector a warning signal once said detector becomes activated.

30. The method as recited in claim 29, which further comprises the step of:

making said warning signal affect said blind individuals through vibrotactile stimulation.

31. The method as recited in claim 25, which further comprises the step of:

suspending adjacent to said platform the means for exposing said hazard zone to said optical signal.

* * * * *